US006234328B1

(12) United States Patent
Mason

(10) Patent No.: US 6,234,328 B1
(45) Date of Patent: May 22, 2001

(54) ADJUSTABLE SHELF SYSTEM

(75) Inventor: Timothy L. Mason, Melville, NY (US)

(73) Assignee: NDR Corporation, Melville, NY (US)

( * ) Notice: Subject to any disclaimer, the term of this patent is extended or adjusted under 35 U.S.C. 154(b) by 0 days.

(21) Appl. No.: 09/405,536

(22) Filed: Sep. 24, 1999

(51) Int. Cl.[7] ..... A47F 5/00

(52) U.S. Cl. ..... 211/90.02; 211/175; 211/150; 248/242

(58) Field of Search ..... 248/242; 211/187, 211/59.2, 59.3, 90.02, 90.03, 90.01, 90.04, 150, 175

(56) References Cited

U.S. PATENT DOCUMENTS

| | | | | |
|---|---|---|---|---|
| D. 393,907 | | 4/1998 | Current . | |
| D. 393,909 | | 4/1998 | Current . | |
| D. 395,089 | | 6/1998 | Current . | |
| D. 400,270 | | 10/1998 | Current . | |
| 3,167,037 | * | 1/1965 | Mapson . | |
| 3,426,993 | * | 2/1969 | Johansson | 248/242 |
| 3,461,713 | * | 8/1969 | Berkowitz . | |
| 3,463,433 | * | 8/1969 | Stein et al. | 248/242 |
| 3,508,665 | * | 4/1970 | Goldstein et al. | 211/150 |
| 4,830,201 | * | 5/1989 | Breslow | 211/59.3 X |
| 5,088,607 | * | 2/1992 | Risafi et al. | 211/59.3 |
| 5,673,801 | * | 10/1997 | Markson | 211/59.3 |
| 6,082,557 | * | 7/2000 | Leahy | 211/59.3 |

* cited by examiner

*Primary Examiner*—Robert W. Gibson, Jr.
(74) *Attorney, Agent, or Firm*—Collard & Roe, P.C.

(57) ABSTRACT

The invention relates to an adjustable shelf system having a shelf with a series of tracks. Connected to the shelf is at least one adjustable support bracket. The support bracket is adjustable because it has a series of vertical tracks connected to a series of horizontal tracks. A shelf bar is slidable within these tracks and allows the shelf to be adjusted based upon its angle and spacing from a slotted wall. Display material can be placed on the shelf in a stack and supported by a weighted pusher. The weighted pusher supports these books by sliding within the tracks of the shelf to a front plate. The front plate is designed to support this display material and also stop the pusher from sliding off an end of the track.

22 Claims, 7 Drawing Sheets

FIG. 2
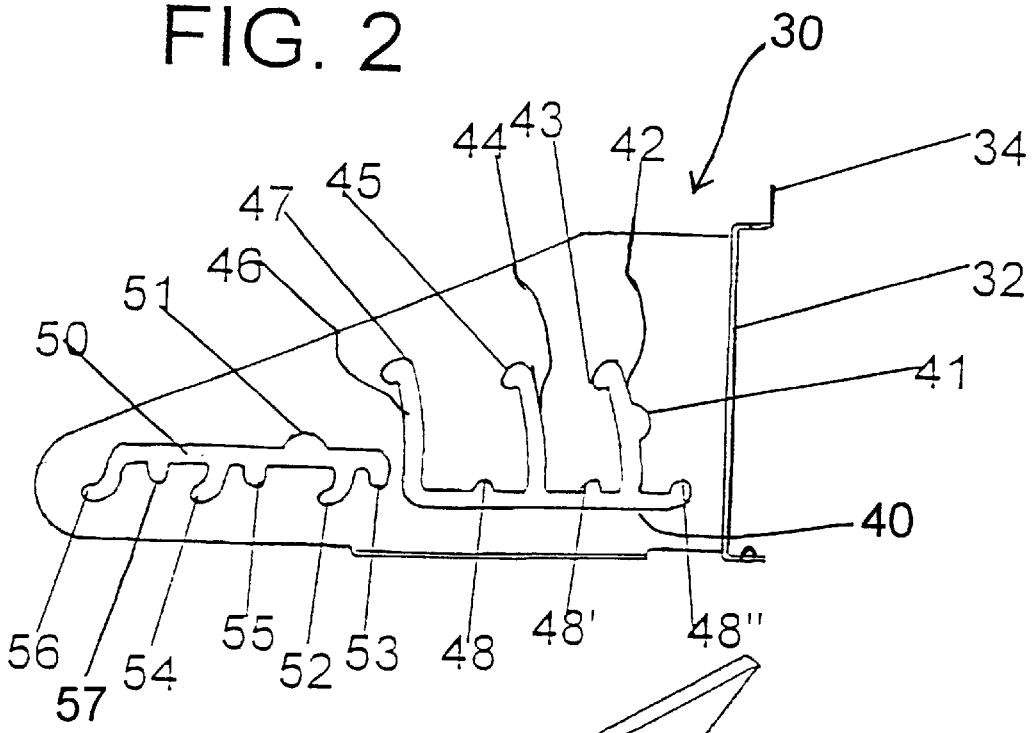
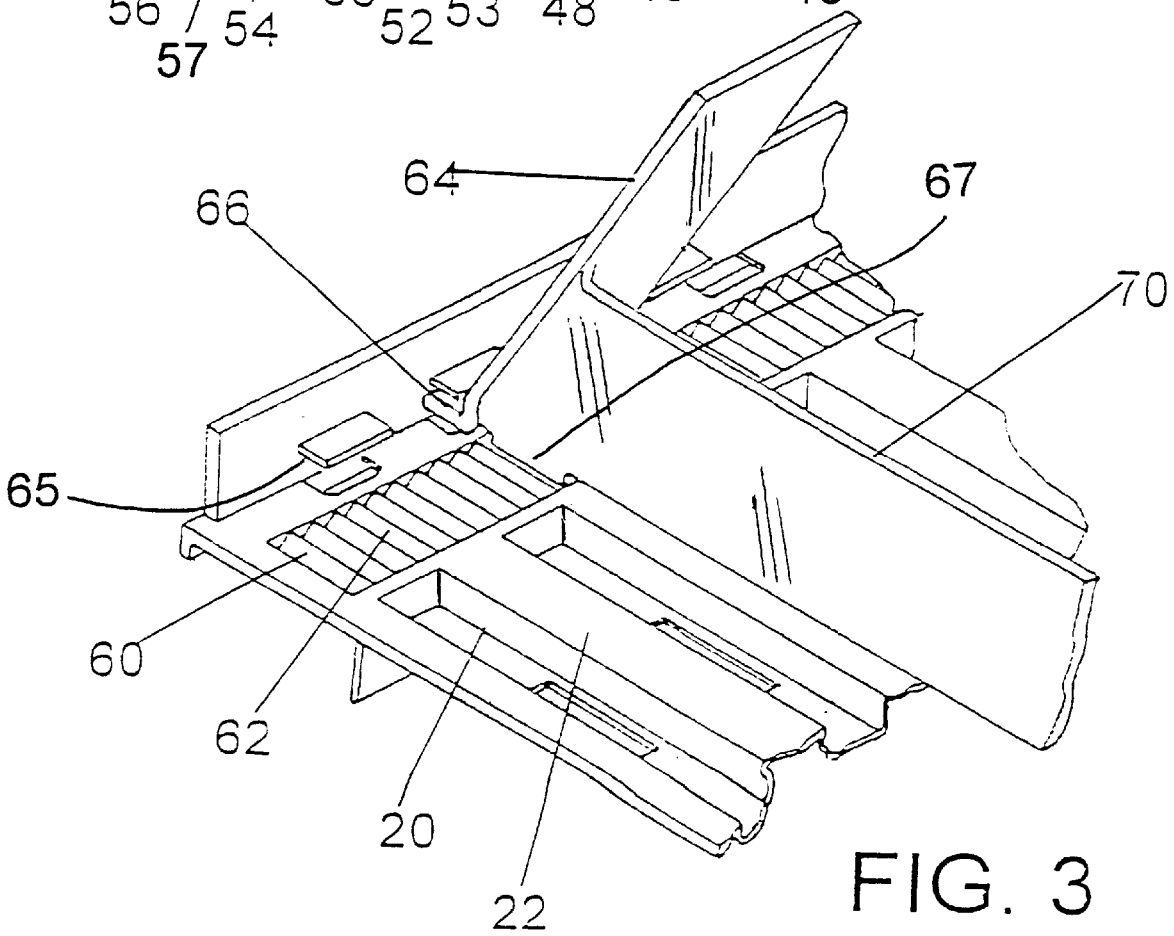
FIG. 3

FIG. 9
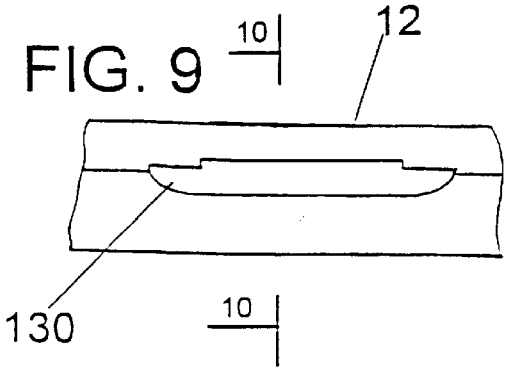
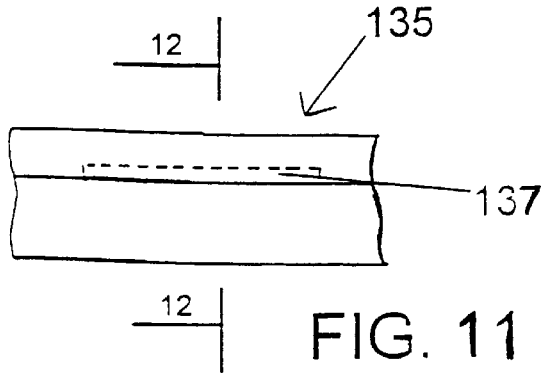
FIG. 11
FIG. 10
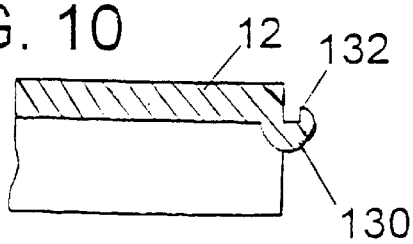
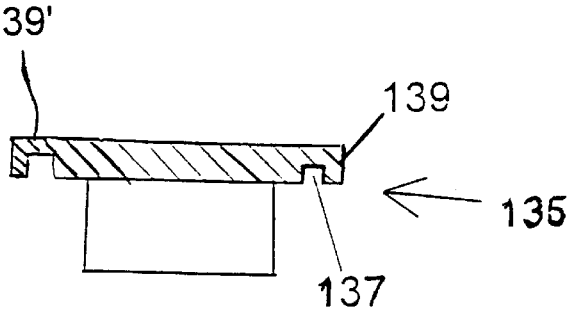
FIG. 12
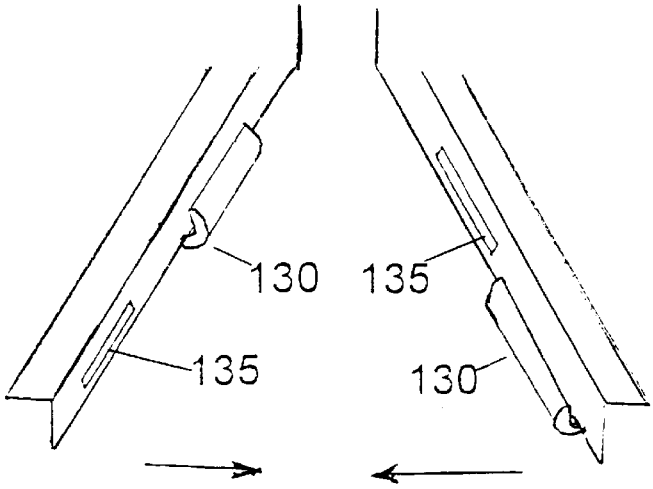
FIG. 13

ADJUSTABLE SHELF SYSTEM

BACKGROUND OF THE INVENTION

1. Field of the Invention

The present invention relates to an adjustable display shelf for displaying retail merchandise in rows in an upright manner.

2. The Prior Art

Adjustable display shelves are generally known in the prior art. However, the adjustable shelf system of the present invention is different from the prior art since the display shelf can be adjusted based upon pitch, width, distance from a wall, or the size of its sections.

SUMMARY OF THE INVENTION

The present invention relates to an adjustable shelf system, comprising a shelf portion having a series of alternating channels and ridges. Located in these channels is a pusher that slides down towards a front plate. Connected to the shelf are two adjustable shelf supporting brackets which connect to a slotted wall. Slotted walls are known in the art. For example, U.S. Design Pat. Nos. 395,089, 393,909, 400,270, and 393,907 assigned to International Visual Corp. disclose an array of slotted walls for connecting with adjustable brackets. In addition, there is a display plate having a price channel for displaying prices on a front end of the shelf.

The shelf system further comprises an adjustable divider for dividing the shelf into different merchandising slots. The adjustable divider is positioned in the shelf substantially parallel to the channels. This adjustable divider contains both a front plate and a back plate. The back plate has a U-shaped clip that is slidably supported in a U-shaped track extending along a back end of the shelf. A front plate is connected to the divider wherein the front plate has a front tab that extends into a receiving track. In addition, adjacent to both the front end and the back end of the divider are extension flanges that fit securely inside a front and back ridge row each extending substantially perpendicular to the divider. The divider can be secured into the shelf when the front tab is inserted into the receiving track. Next, the extension flanges are inserted into both the front and back ridge row so that the back U-shaped clip locks rigidly into the U-shaped track.

In this way, merchandise on display can be set upon this shelf and stacked between the pusher and the front display plate or channel. When one display piece or merchandise item is removed, the pusher slides down towards the front display plate to move the remaining items to the front of the display.

Connecting the shelf to a slotted wall are two shelf supporting brackets. The shelf support brackets contain a series of vertical and horizontal tracks having a series of notches which allow for adjustments in the shelf system. These notches are set so that the shelf system can be mounted at different distances from a slotted wall and at different angles to a slotted wall. For example, the shelf system could be mounted at approximately a right angle to the slotted wall or it could be mounted at a 20° to 30° down sloping angle to the slotted wall. Thus, in the downsloping positions, the shelf can be arranged at three different distances from the slotted wall. In addition, in the horizontal position the shelf can be positioned at three different distances from the slotted wall.

The shelf system also comprises a series of ridges disposed adjacent to the tracks on the shelf which define a ridge row that extends perpendicular to the extension of the tracks. These ridges interact so that they catch a divider and control its lateral adjustability.

The pusher contains a series of pellets or weighted objects so that it will slide forward based upon gravity if the shelf system tilts downward. The pusher also attaches to an L-shaped support plate for supporting merchandise upright. This L-shaped support plate can be designed to receive books, promotional materials, magazines or other self supporting merchandise.

The shelf system can also contain a connecting system which allows the shelf system to be expanded laterally. This connecting system comprises male and female connecting elements disposed on the sides of the shelf. The male connecting element is a L-shaped connecting member with a first section extending out from the shelf and a second section or ridge extending up from the first section. In addition, the female connecting element comprises a notch, cut into the shelf, for receiving the male connecting member. One benefit from this multi-adjustable shelf system is that it gives manufacturers greater flexibility in design so that it allows these manufacturers to customize these displays to match their orders.

It is an object of the present invention to provide an adjustable shelf system for displaying merchandise or other promotional materials.

It is another object of the present invention to provide a shelf system that has adjustable support brackets for adjusting its display angle.

It is still another object of the invention to provide an adjustable shelf system that is simple in design, easy to install, and inexpensive to manufacture.

BRIEF DESCRIPTION OF THE DRAWINGS

Other objects and features of the present invention will become apparent from the following detailed description considered in connection with the accompanying drawings which disclose one embodiment of the present invention. It should be understood, however, that the drawings are designed for the purpose of illustration only and not as a definition of the limits of the invention.

In the drawings, wherein similar reference characters denote similar elements throughout the several views:

FIG. 2 is a side view of the support bracket of the shelf of FIG. 1;

FIG. 3 is a perspective view of the adjustable divider and front plate inserted into the shelf;

FIG. 9 is a front end view of a male connecting element on the shelf;

FIG. 10 is a side view of the male connecting element on the shelf;

FIG. 11 is a front end view of the female connecting element on the shelf;

FIG. 12 is a side view of the female connecting element;

FIG. 13 is a perspective view of two shelves connecting to each other; and

DETAILED DESCRIPTION OF PREFERRED EMBODIMENTS

Figure 1:
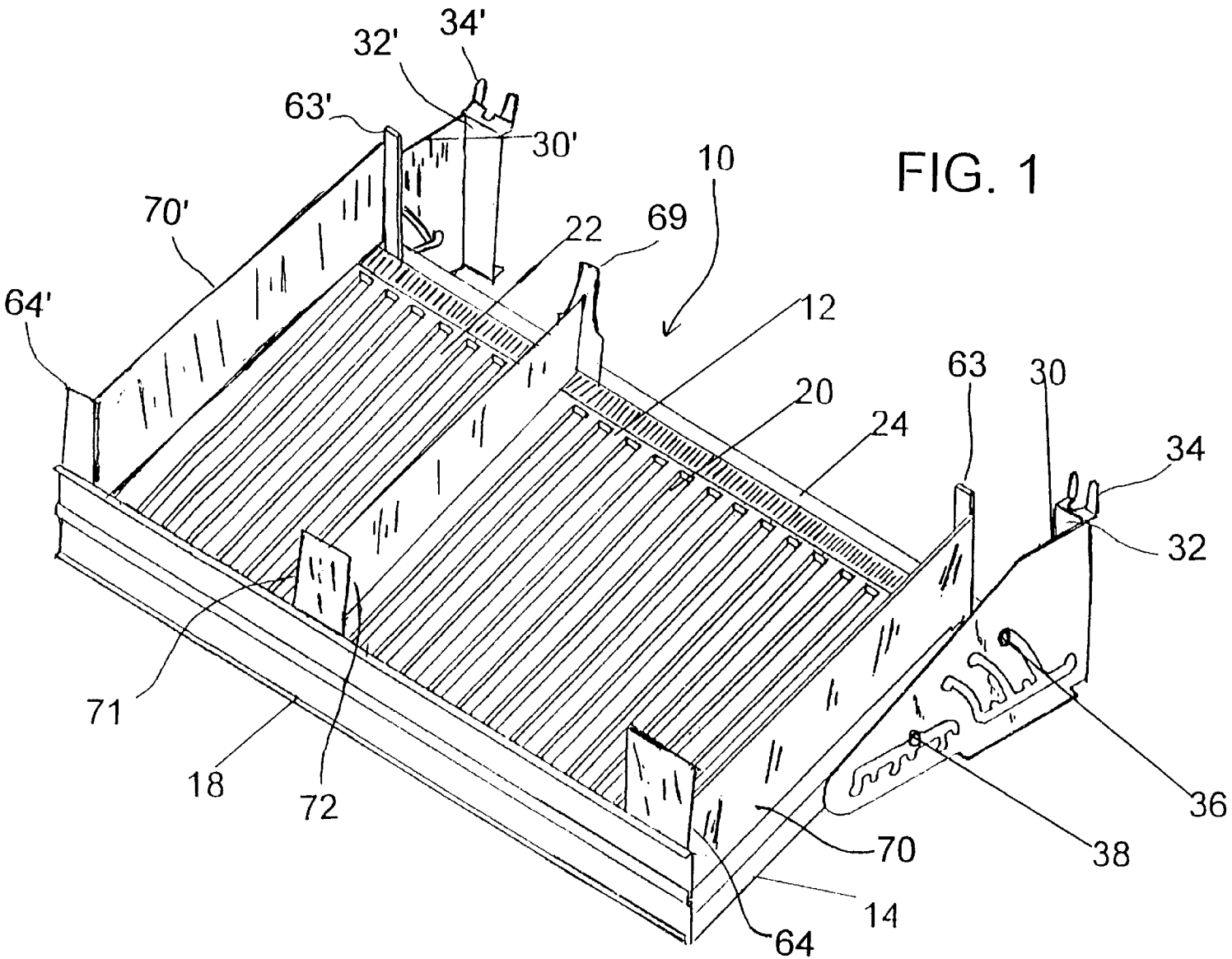
FIG. 1 is a perspective view of the shelf system according to the invention.
Figure 14:
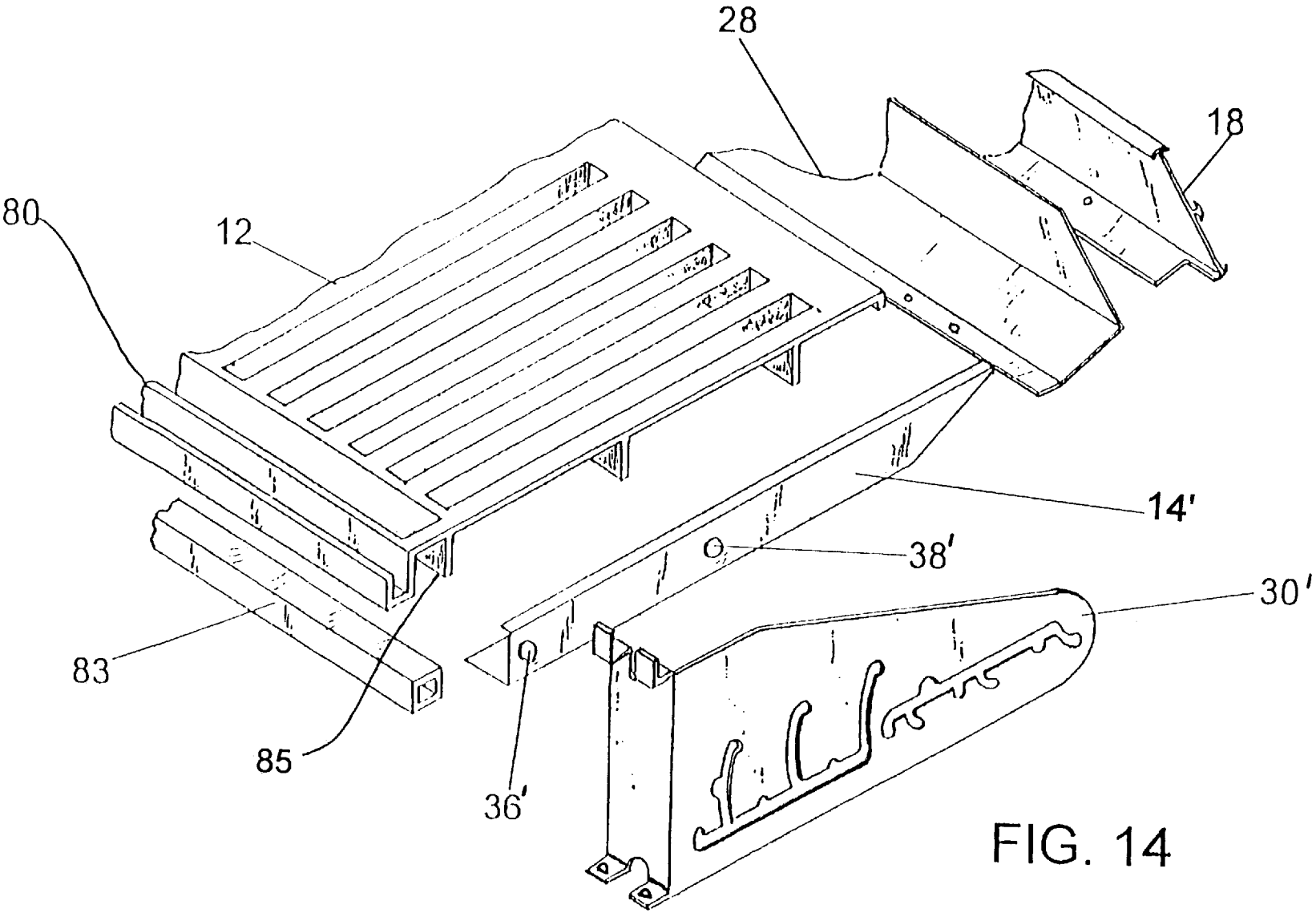
FIG. 14 is a exploded view of one side of the shelf system.

In the drawings, FIG. 1 shows a perspective view of the shelf system 10, having a plastic shelf 12 connected to two U-shaped metal plates 14 and 14' (FIG. 14). Metal plate 14 has pins 36 and 38 while metal plate 14' has pins 36' and 38' wherein these pins extend laterally out from plates 14 and 14'. These pins connect to stamped metal shelf supporting side brackets 30 and 30' on either side. Side shelf support brackets 30 and 30' connect to a slotted wall (not shown). This slotted wall allows shelf 12 to be adjusted in height.

Shelf 12 can be divided into several different product slots. For example, connected to shelf 12 are a series of adjustable dividers 70, 70' and 72 for dividing shelf 12 into different regions. Dividers 70 and 70' each have a back plate 63 and 63' and a front plate 64 and 64'. Front plate 64 (FIG. 3) contains tab 66 that fits inside slot 65 on shelf 12. So that divider 70 can be secured to shelf 12 when tab 66 is inserted into slot 65. Next, extension flange 67 is inserted into ridge row 60 and locked in place between ridges 62. At a back end, divider 70 having a back extension flange 67' (FIG. 5), is inserted into ridge row 60'.

Middle divider 72 (FIG. 1) splits a middle section of shelf 12 and has a back plate 69 attached to a back end and a front plate 71 attached to a front end. In middle divider 72, back plate 69 extends out from both sides while front plate 71 also extends out from both sides.

In addition, connected to the front end of shelf 12 is a front channel 18. Front channel 18 connects to shelf 12 at an acute angle of 60° to 70° so that if shelf 12 slopes down at a 20° to 30° angle, front channel 18 remains substantially vertical.

The center region of shelf 12 contains a series of approximately ½ inch channels 20 and approximately ½ inch ridges 22. These alternating channels 20 and ridges 22 allow a pusher (FIG. 8A) to slide within. Finally, connected to side support brackets 30 and 30' are connecting plates 32 and 32' having U-shaped connecting hooks 34 and 34'. These U-shaped connecting hooks 34 and 34' fit inside the slotted wall.

As shown in FIG. 2, side support bracket 30 contains a first horizontal track 40 and second horizontal track 50. First horizontal track 40 branches into a series of vertical tracks 42, 44, and 46. First vertical track 42 has an enlarged semi-circular notch 41 spaced halfway up track 42 and a second semi-circular notch 43 disposed at an end of track 42. First semicircular notch 41 is enlarged over remaining track 40 so as to receive pin 36 (FIG. 1) within track 40. Pin 36 has a shaft that slides within track 40 and a head that covers over track 40 to secure pin 36 within track 40. However, pin 36 can insert into and be removed from track 40 through enlarged notch 41. Both vertical track 44 and vertical track 46 have semi-circular notches 45, and 47 located at an end of these tracks. In addition, a series of semicircular notches 48, 48', and 48" are located along horizontal track 40.

Second horizontal track 50 extends along support bracket 30 adjacent to track 40. Track 50 is designed to receive pin 38 (FIG. 1) so that pin 38 has a shaft that moves within track 50 and a head that extends across the width of track 50. However pin 38 is insertable into and removable from track 50 through an enlarged hole 51. Enlarged hole 51 is designed to accommodate the head of pin 38 and allows pin 38 to move within horizontal track 50. A series of downward sloping substantially vertical tracks 52, 54 and 56 extend off of track 50. In addition, a series of semi-circular notches 53, 55, and 57 extend down off of track 50 and alternate with vertical tracks 52, 54 and 56.

These semi-circular notches are designed to lock onto pins 36 and 38 attached to shelf 12. In this way, shelf support bracket 30 remains adjustable so that shelf 12 can be positioned at different angles and depths. For example, these support brackets 30 and 30' provide three horizontal and three sloped positions for shelf 12. The first horizontal position occurs when pin 36 is lodged in semicircular notch 48" and pin 38 is lodged in semicircular notch 53. In this way, the back end of shelf 12 pushes up on pin 36 and the front end of the shelf 12 pushes down on pin 38. In the second horizontal position, pin 36 is lodged in semicircular notch 48' and pin 38 is lodged in semicircular notch 55. Finally, in the third horizontal position, pin 36 is lodged in semicircular notch 40 while pin 38 is lodged in semicircular notch 57. Thus, the side shelf support brackets 30 and 30' allow shelf 12 to be positioned at varying distances away from a slotted wall.

In addition, side brackets 30 and 30' allow the shelf to be positioned at a downward sloping angle of 20° to 30° from horizontal. In the first sloped position, pin 36 is lodged in semicircular notch 43 on vertical track 42, while pin 38 is lodged in downward sloping track 52. In the second sloped position, pin 36 is lodged in semicircular notch 45 in vertical track 44, while pin 38 is lodged in downward sloping track 54. Finally, in the third sloped position, pin 36 is lodged in semicircular notch 47, in track 46, while pin 38 is lodged in downward sloping track 56. Thus, in these three sloped positions, shelf 12 can be positioned at varying distances from a slotted wall. In addition, these semicircular notches 43, 45, and 47 and slots 52, 54, 56 slope downwardly and forward so that pins 36 and 38 do not move vertically once shelf 12 is put in its fixed position.

FIG. 3 shows an adjustable divider 70 having a sloped front plate 64. Front plate 64 has tab 66 that rests upon shelf 12 and fits inside slot 65. Divider 70 contains a first downward extending region 67 on its front end, and a second downward extending region 67' (See FIG. 5) on its back end. These regions insert into a series of ridges 62 in a front ridge row 60 and into ridges 62' in rear ridge row 60'. Thus, these dividers allow shelf 12 to be divided into separate regions so that different types of merchandise material can be merchandised on shelf 12.

Figure 4:
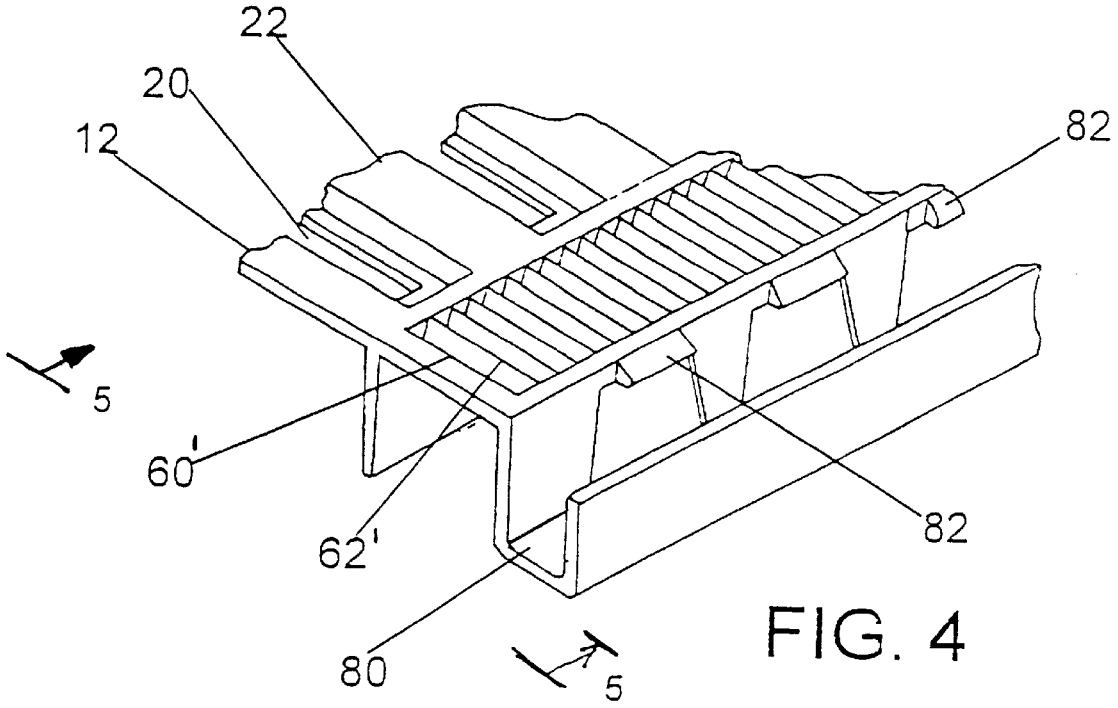
FIG. 4 is a perspective view of a back end of the shelf.
Figure 5:
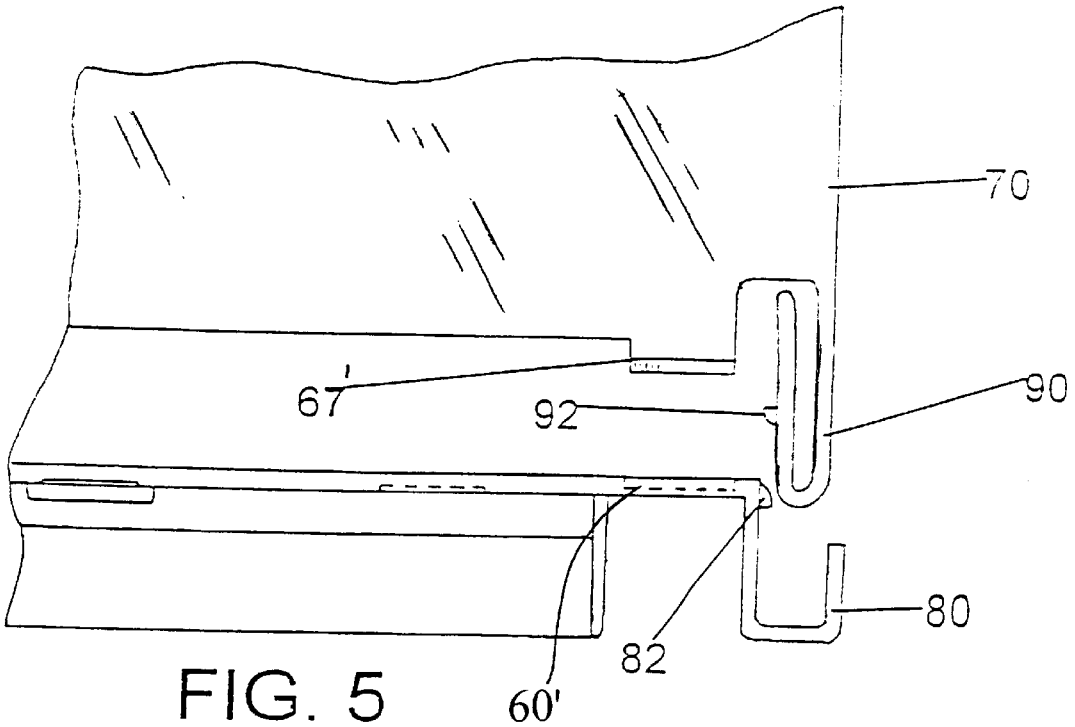
FIG. 5 is a side view of the back end of the shelf.

FIG. 4 shows a perspective view of a back end of shelf 12 having a U-shaped recess 80. Recess 80 is disposed adjacent to back ridge row 60' having a series of ridges 62' and contains a series of flanges 82 that lock U-shaped divider support 90 (FIG. 5) in place. As shown in FIG. 5, divider 70 contains a downward extending tab 67' that locks into ridge row 601. In addition, U-shaped support 90 has a triangular shaped tab 92 that extends out therefrom locking with flanges 82.

Figure 6:
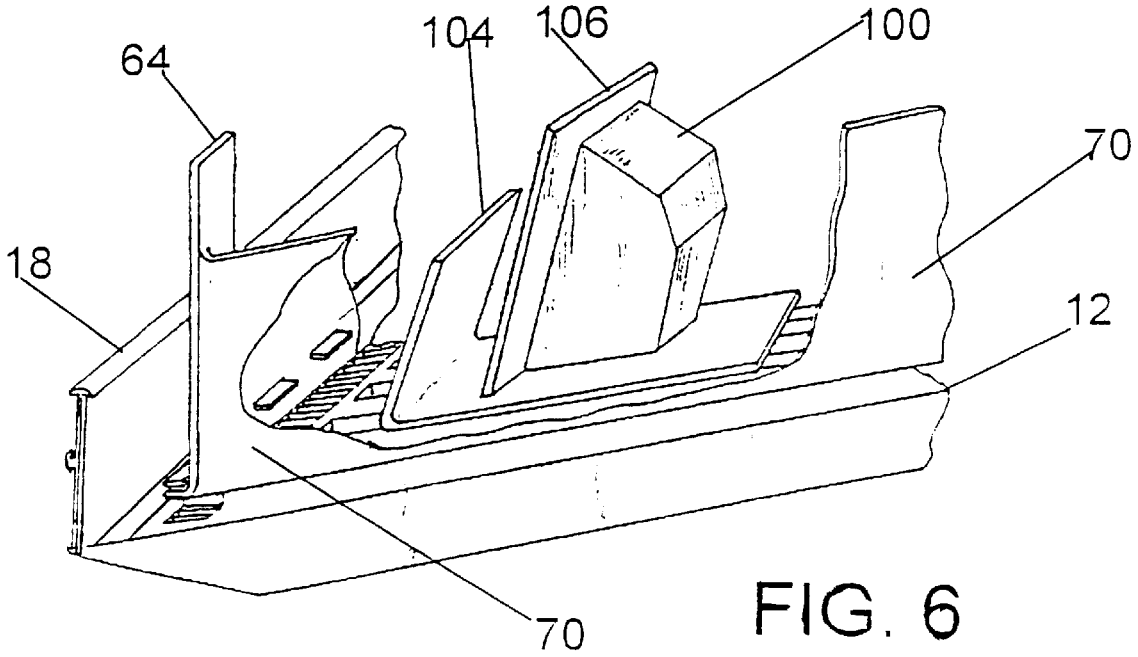
FIG. 6 is a perspective view of a pusher for sliding on the shelf.
Figure 7:
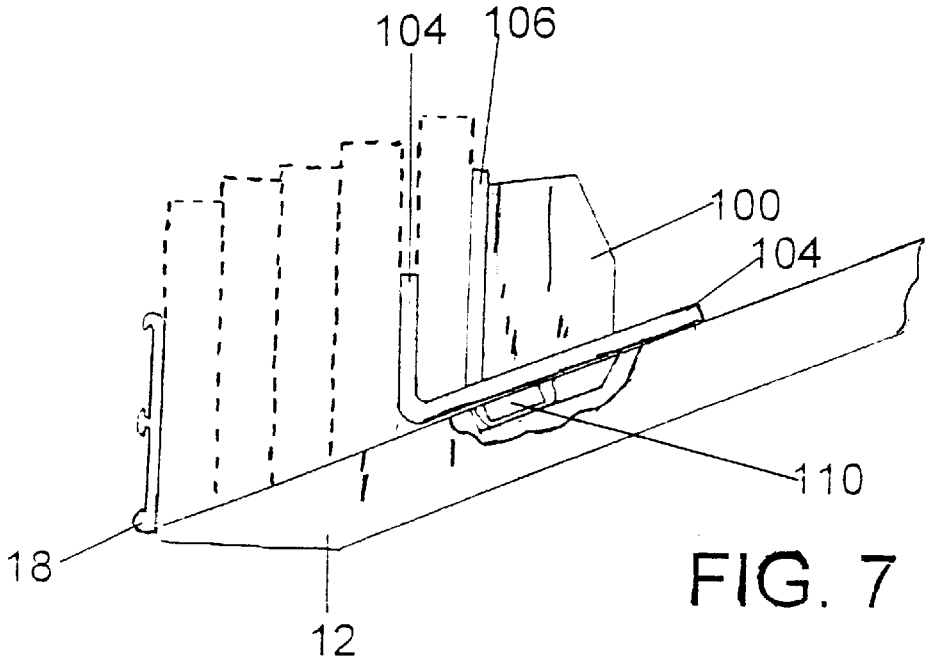
FIG. 7 is a side view of the pusher for sliding on the shelf.

FIG. 6 shows a pusher 100 connected to a sled 104. Sled 104 is L-shaped and slides down shelf 12. Attached to a front end of pusher 100 is a support plate 106. With this design, a book or other merchandise material (see FIG. 7) can be inserted between an upward extending portion of sled 104 and supported by support plate 106. FIG. 7 shows a cutaway view of shelf 12. Extending down from sled 104 are tracks 110, 110' 112 and 112' (FIG. 8B) that fit into channels 20 on shelf 12 (FIG. 1). Because track 110 fits inside channels 20, pusher 100 can slide down shelf 12 in channel 20 in a linear manner. This design also allows a series of books or other display items to be placed in front of pusher 100.

Figure 8B:
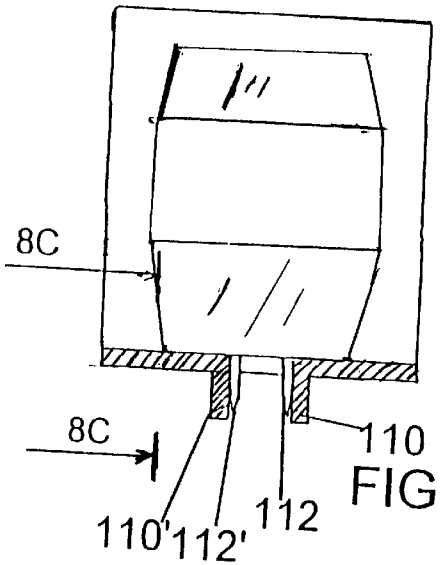
FIG. 8B is a back view of the pusher.
Figure 8C:
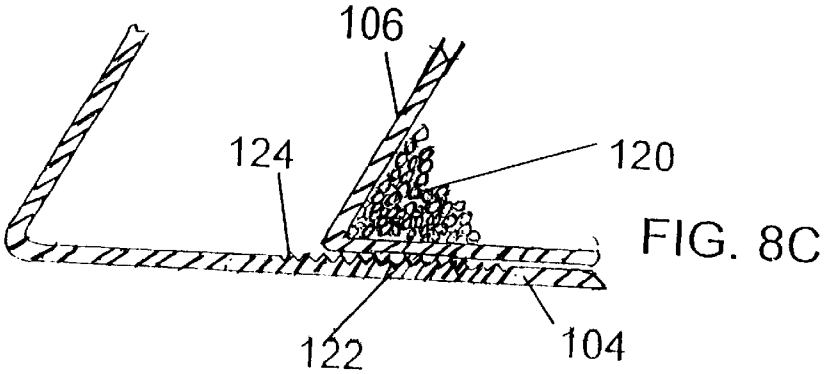
FIG. 8C is a cross sectional view of the pusher as it attaches to a L-shaped sled.
Figure 8A:
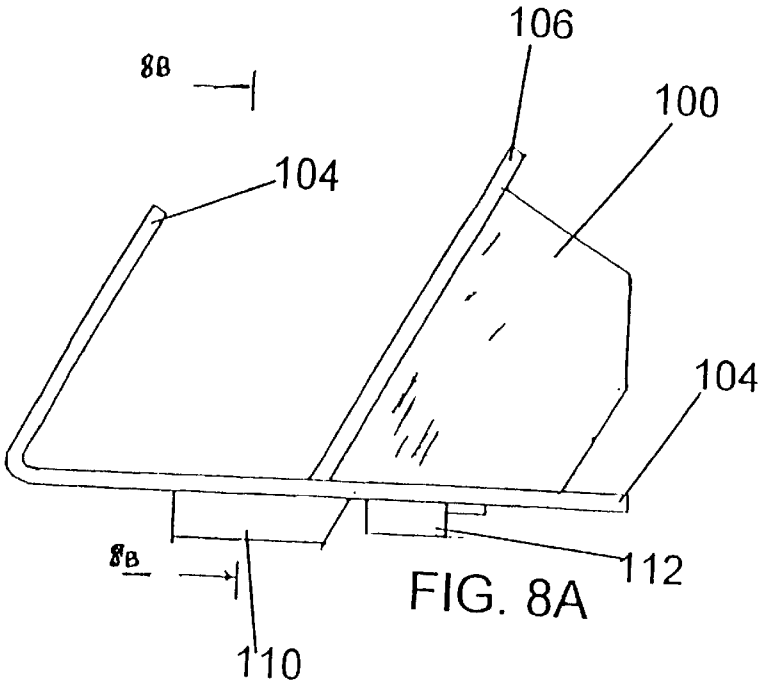
FIG. 8A is a side view of the pusher.

FIG. 8A shows a side view of pusher 100. Track 110 connects to sled 104 while track 112 connects to pusher 100 while both tracks 110 and 112 extend below sled 104. FIG. 8B shows a back view of pusher 100, having tracks 110 and 110' disposed outside of tracks 112 and 112'. Tracks 110 and 110' are spaced apart so that they receive tracks 112 and 112' while fitting inside channel 20 on shelf 12.

FIG. 8C shows a cross sectional view of pusher 100 which contains a series of weighted pellets 120 housed inside. These weighted pellets cause pusher 100 to slide down channels 20 on shelf 12, based upon gravity. In addition, pusher 100 contains a downward extending rib 122 that extends into upward extending ridges or sawtooth 124 on sled 104. This rib 122 and corresponding ribs 124 interact so that pusher 100 is adjustable forward and back on sled 104, but locks in place once a book is held in place on sled 104.

FIG. 9 shows a side view of shelf 12 having a male connecting bracket 130 that has a upward extending ridge 132 shown in FIG. 10. This male bracket 130 fits inside a female bracket 135 shown in FIG. 11. As shown in FIG. 12, female bracket 135 is shaped as a notch 137 cut inside an overhang 139. As shown in FIG. 13, each shelf 12 has a male connecting bracket 130 and a female connecting bracket 135. When each shelf 12 intersects the other, male connecting brackets 130 interact with the female connecting brackets 135 so that they lock with each other. Thus, in these shelf systems, a series of shelves 12 can be connected to each other laterally.

FIG. 14 shows an exploded view of shelf system 10 showing how plate 14' attaches to shelf 12. Plate 14' contains pins 36 and 38 wherein pins 36 and 38 each have a shaft and a head. Support bar 83 connects to shelf 12 in channel 85 adjacent to channel 80 on shelf 12. Support bar 83 provides lateral support for shelf 12 so that shelf 12 can support a heavy load of books or other promotional materials. Front support bracket 28 connects to a front end of shelf 12 wherein front channel 18 connects to front support bracket 28.

Accordingly, while one embodiment of the present invention has been shown and described, it is to be understood that many changes and modifications may be made thereunto without departing from the spirit and scope of the invention as defined in the appended claims.

What is claimed is:

1. An adjustable shelf system connected to a support element comprising:

at least one shelf having at least one channel;

at least one shelf supporting bracket for connecting said at least one shelf to the support;

at least one adjustable divider for dividing said at least one shelf, said at least one adjustable divider being positioned in said at least one shelf substantially parallel to said at least one channel;

at least one connecting system for connecting said at least one shelf to at least one additional shelf;

at least one front plate disposed on said shelf; and at least one pusher for sliding down said at least one channel to said at least one front plate;

wherein a plurality of items for display set upon said shelf are stacked between said at least one pusher and said at least one front plate so that said at least one pusher slides down said at least one channel and supports the display items in an upright manner.

2. The shelf system as in claim 1, wherein said at least one shelf supporting bracket is adjustable for positioning said at least one shelf in at least two different angles with respect to the wall bracket.

3. The shelf system as in claim 2, wherein said at least one front plate is connected to said at least one adjustable divider, said at least one front plate being slidably supported in a track extending along said at least one shelf.

4. The shelf system as in claim 1, further comprising a series of ridges disposed on said shelf adjacent to said channel.

5. The shelf system as in claim 4, wherein said at least one divider can be adjusted along said shelf in said ridges at 1/8 inch increments.

6. The shelf system as in claim 1, wherein said at least one connecting system comprises at least one male connecting element and at least one female connecting element.

7. The shelf system as in claim 1, wherein said at least one support bracket supports said at least one shelf in at least two different depths from a slotted wall.

8. The shelf system as in claim 5, wherein said at least one support bracket supports said at least one shelf at a substantially right angle to a said slotted wall.

9. The shelf system as in claim 5, wherein said at least one support bracket supports said at least one shelf at a substantially 20° to 30° downward sloping angle from horizontal.

10. The shelf system as in claim 9, wherein said front plate connects to said at least one shelf at a substantially 60° to 70° angle so that when said at least one shelf slopes down, said front plate remains substantially vertical.

11. The shelf system as in claim 1, further comprising at least one pin extending out from said at least one shelf, said at least one pin connecting said at least one shelf to said at least one shelf supporting bracket.

12. The shelf system as in claim 9, further comprising at least two pins for connecting said at least one shelf to said at least one support bracket.

13. The shelf system as in claim 12, wherein said at least one support bracket contains at least one substantially horizontal slot for receiving said at least one pin, said at least one pin being slidable within said at least one horizontal slot so that said at least one shelf is positionable at different distances from the slotted wall.

14. The shelf system as in claim 12, wherein said at least one support bracket contains at least two substantially vertical slots wherein said at least two pins fit slidably inside said at least two vertical slots so that said at least one shelf is adjustable to at least two different angles in relation to the slotted wall.

15. The shelf system as in claim 13, wherein said at least one support bracket has at least two vertical slots connected to said at least one horizontal slot wherein to adjust the distance between said at least one shelf and the slotted wall, said pins slide within said at least one horizontal slot and adjust at an angle of intersection between said at least one shelf and the slotted wall so that said at least two pins slide within said at least two vertical slots.

16. The shelf system as in claim 15, wherein said at least one support bracket further comprises notches disposed along said at least one horizontal slot and said at least two vertical slots so that said at least two pins can lock with said notches to lock said at least one support bracket in a stationary position.

17. A support bracket for supporting a shelf on a slotted wall, the bracket comprising:

a) a side plate for connecting to the shelf; and b) an end plate attached to the side plate, the end plate for connecting to the slotted wall;

wherein said side plate has at least one substantially horizontal slot and at least two substantially vertical slots so that the shelf can be adjusted to at least two different depths from the slotted wall and at least two different angles from the slotted wall.

18. The support bracket as claimed in claim 17, wherein said side plate further comprises a series of notches spaced along said at least one horizontal slot and said at least two substantially vertical slots wherein said notches are designed to receive a pin disposed on the attached shelf.

19. The support bracket as claimed in claim 18, wherein said end plate contains a first U-shaped hook extending up from said end plate and a second U-shaped hook extending out from said end plate so that said first and said second hooks connect to the slotted wall.

20. The support bracket as claimed in claim 19, wherein said side plate contains a second horizontal slot so that said shelf is supported by at least two pins fitting into said horizontal slots.

21. An adjustable shelf system connected to a support element comprising:

at least one shelf having at least one channel;

at least one shelf-supporting bracket for connecting said at least one shelf to the support;

at least one adjustable divider for dividing said at least one shelf, said at least one adjustable divider being positioned in said at least one shelf substantially parallel to said at least one channel;

at least one front plate disposed on said shelf;

at least one pusher for sliding down said at least one channel to said at least one front plate; and at least one substantially upright support plate disposed on said pusher for supporting a display object upright on said pusher;

wherein a plurality of items for display set upon said shelf are stacked between said at least one pusher and said at least one front plate so that said at least one pusher slides down said at least one channel and supports the display items in an upright manner.

22. An adjustable shelf system connected to a support element comprising:

at least one shelf having at least one channel;

at least one shelf-supporting bracket for connecting said at least one shelf to the support;

at least one adjustable divider for dividing said at least one shelf, said at least one adjustable divider being positioned in said at least one shelf substantially parallel to said at least one channel;

at least one front plate disposed on said shelf;

wherein said shelf can be adjusted to at least two different depths from the support element and also adjusted to at least two different angles with respect to the support element by adjusting said shelf in said at least one shelf-supporting bracket.

* * * * *